US011786104B2

(12) United States Patent
Kremmel

(10) Patent No.: US 11,786,104 B2
(45) Date of Patent: Oct. 17, 2023

(54) REMOVABLE RACK ACCESSORY FOR A DISHWASHING APPLIANCE

(71) Applicant: Haier US Appliance Solutions, Inc., Wilmington, DE (US)

(72) Inventor: Aldo Vincent Kremmel, Palmyra, IN (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 0 days.

(21) Appl. No.: 17/698,294

(22) Filed: Mar. 18, 2022

(65) Prior Publication Data

US 2023/0292987 A1 Sep. 21, 2023

(51) Int. Cl.
*A47L 15/50* (2006.01)

(52) U.S. Cl.
CPC ..... *A47L 15/505* (2013.01); *A47L 15/502* (2013.01)

(58) Field of Classification Search
CPC ..... A47L 15/50; A47L 15/502; A47L 15/503; A47L 15/505
USPC ..... 211/41.1–41.9
See application file for complete search history.

(56) References Cited

U.S. PATENT DOCUMENTS 2,708,037 A * 5/1955 Planeta ..... A47L 19/04 211/74
4,836,392 A * 6/1989 Constantino ..... A61J 11/00 211/41.9
D516,757 S * 3/2006 Hedstrom ..... A47L 15/503 D32/3
7,665,475 B2 2/2010 Hedstrom et al.
7,766,175 B2 * 8/2010 Jadhav ..... A47L 15/505 211/41.9
8,701,898 B2 * 4/2014 Chai ..... A47L 15/503 211/41.6
8,789,711 B2 * 7/2014 Haltmayer ..... A47L 15/503 211/41.9
9,033,432 B2 * 5/2015 Kilic ..... A47L 15/503 312/228.1
D732,754 S * 6/2015 Roberson ..... D32/3
9,131,828 B2 * 9/2015 Yoon ..... A47L 15/503
9,615,722 B2 * 4/2017 Mesa ..... A47L 15/50
10,052,012 B2 * 8/2018 Mesa ..... A47L 15/50
10,165,927 B2 * 1/2019 Mesa ..... F16B 2/22
10,945,585 B2 * 3/2021 Mohite ..... A47L 15/503
11,006,814 B1 * 5/2021 Simmonds ..... A47L 15/503
2020/0281441 A1 * 9/2020 Kim ..... A47L 15/505

FOREIGN PATENT DOCUMENTS

CN 208755912 U 4/2019
CN 209884077 U 1/2020
CN 209932658 U 1/2020
(Continued)

*Primary Examiner* — Patrick D Hawn
(74) *Attorney, Agent, or Firm* — Dority & Manning, P.A.

(57) ABSTRACT

A removable lid rack for a dishwashing appliance includes a body including a plurality of struts extending along the lateral direction, the plurality of struts collectively defining a plurality of apertures; a mounting portion extending from the body along the vertical direction, the mounting portion including a slide tab extending along the transverse direction; a snap hook protruding from the body along the vertical direction; and a locator hook protruding from the body along the lateral direction away from the plurality of apertures.

18 Claims, 5 Drawing Sheets

(56) References Cited

FOREIGN PATENT DOCUMENTS

| | | | |
|---|---|---|---|
| EP | 3357398 | A1 | 8/2018 |
| EP | 3788936 | A1 | 3/2021 |
| WO | WO2016192797 | A1 | 12/2016 |

* cited by examiner

REMOVABLE RACK ACCESSORY FOR A DISHWASHING APPLIANCE

FIELD OF THE INVENTION

The present subject matter relates generally to dishwashing appliances, and more particularly to removable accessories for dishwashing appliances.

BACKGROUND OF THE INVENTION

A dishwasher or dishwashing appliance generally includes a tub that defines a wash chamber for receipt of articles for washing. Certain dishwashing appliances also include a rack assembly slidably mounted within the wash chamber. A user can load articles, such as plates, bowls, glasses, or cups, into the rack assembly, and the rack assembly can support such articles within the wash chamber during operation of the dishwashing appliance.

Some items are notoriously difficult to wash in most dishwashers. For example, lids to travel mugs, child drinking containers, and the like are not easily accepted within or on traditional rack assemblies. Because many rack assemblies are wire framed, large gaps are formed through which certain small objects may easily fall. These objects can then clog the drain system of the dishwasher. Further, certain smaller objects may collect water throughout a dishwashing operation when placed on a traditional rack assembly in a flat manner. This may lead to water stains or other undesirable after effects of a washing operation.

Accordingly, a rack accessory that obviates one or more of the above-mentioned drawbacks would be beneficial. In particular, an adjustable rack accessory that holds smaller objects within a dishwashing appliance (e.g., while preventing the collection of standing water thereon) would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a removable rack accessory for a dishwasher appliance is provided. The removable rack accessory may include a body including a plurality of struts extending along the lateral direction, the plurality of struts collectively defining a plurality of apertures, a mounting portion extending from the body along the vertical direction, the mounting portion including a slide tab extending along the transverse direction, wherein the mounting portion is configured to rotatably attach the body to a wash rack within the dishwasher appliance, a snap hook protruding from the body along the vertical direction for selectively latching the body to the wash rack, and a locator hook protruding from the body along the lateral direction away from the plurality of apertures.

In another exemplary aspect of the present disclosure, a dishwashing appliance is provided. The dishwashing appliance may include a tub defining a wash chamber, a rack assembly slidably disposed within the wash chamber, and a removable rack accessory rotatably attached to the rack assembly, the removable rack accessory defining a vertical direction, a lateral direction, and a transverse direction. The removable rack accessory may include a body including a plurality of struts extending along the lateral direction, the plurality of struts collectively defining a plurality of apertures, a mounting portion extending from the body along the vertical direction, the mounting portion comprising a slide tab extending along the transverse direction, wherein the mounting portion is configured to rotatably attach the body to a wash rack within the dishwashing appliance, a snap hook protruding from the body along the vertical direction for selectively latching the body to the wash rack, and a locator hook protruding from the body along the lateral direction away from the plurality of apertures.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
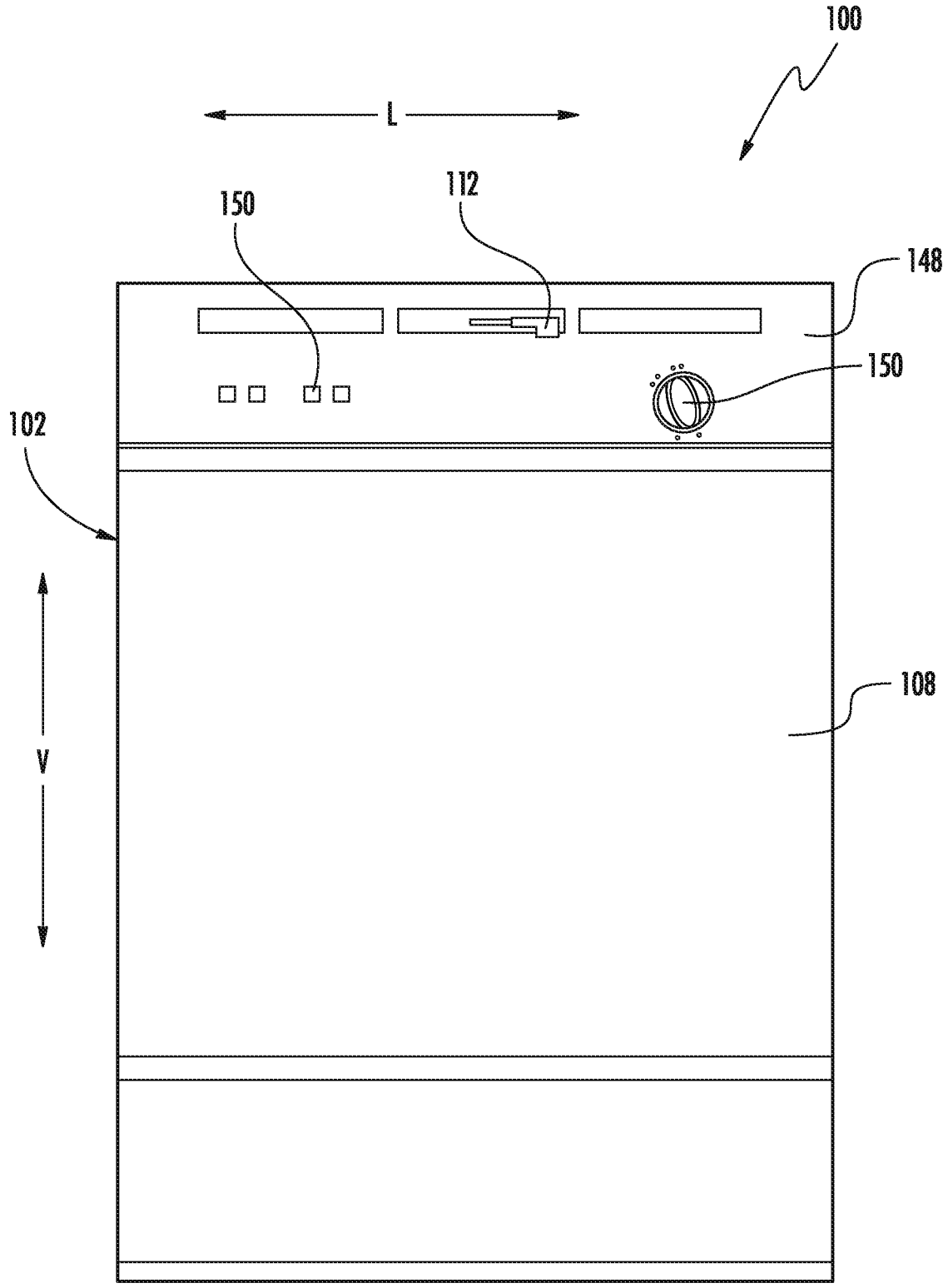
FIG. 1 provides a front elevation view of a dishwashing appliance according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
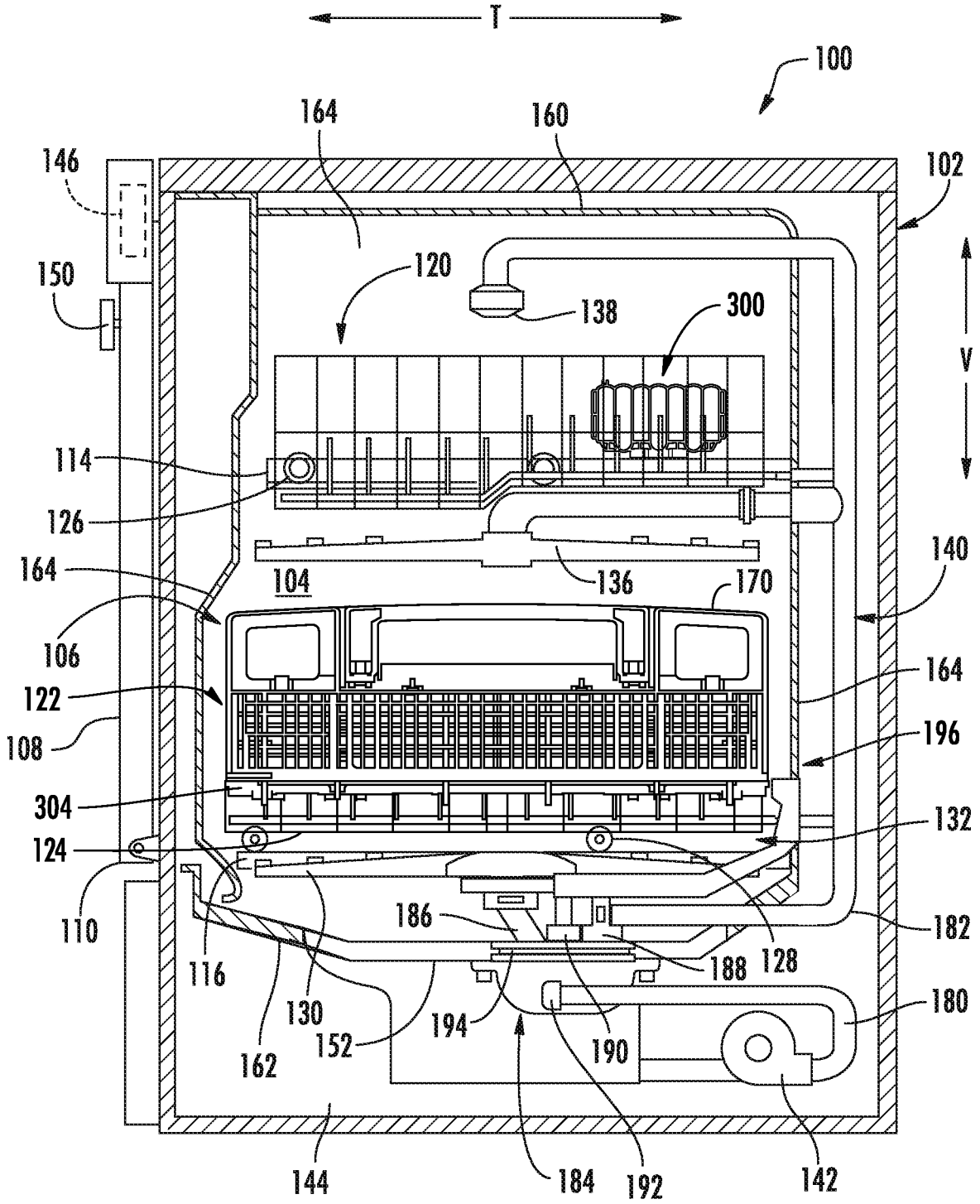
FIG. 2 provides sectional elevation view of the exemplary dishwashing appliance of FIG. 1.

Turning now to the figures, FIGS. 1 and 2 illustrate exemplary embodiments of a domestic dishwashing appliance 100 that may be configured in accordance with aspects of the present disclosure. As shown in FIGS. 1 and 2, the dishwashing appliance 100 may include a cabinet 102 having a tub 104 therein defining a wash chamber 106. The tub 104 may generally include a front opening (not shown) and a door 108 hinged at its bottom 110 for movement between a normally closed vertical position (shown in FIGS. 1 and 2), wherein the wash chamber 106 is sealed shut for washing operation, and a horizontal open position for loading and unloading of articles from the dishwasher. Optionally, a latch 112 may be used to lock and unlock the door 108 for access to the chamber 106.

Generally, the tub 104 may define a discrete vertical direction V, lateral direction L, and transverse direction T. Vertical direction V, lateral direction L, and transverse direction T are orthogonally oriented such that vertical direction V, lateral direction L, and transverse direction T form an orthogonal directional system.

As is understood, the tub 104 may generally have a rectangular cross-section defined by various wall panels or walls. For example, as shown in FIG. 2, the tub 104 may include a top wall 160 and a bottom wall 162 spaced apart from one another along a vertical direction V of the dishwashing appliance 100. Additionally, the tub 104 may include a plurality of sidewalls 164 (e.g., three sidewalls) extending between the top and bottom walls 160, 162. It should be appreciated that the tub 104 may generally be formed from any suitable material. For instance, in several embodiments, the tub 104 is formed from a ferritic material, such as stainless steel, or a polymeric material.

As particularly shown in FIG. 2, upper and lower guide rails 114, 116 may be mounted on opposing sidewalls 164 of the tub 104 and may be configured to accommodate roller-equipped rack assemblies 120 and 122. Each of the rack assemblies 120, 122 may be fabricated into lattice structures including a plurality of elongated members 124 (for clarity of illustration, not all elongated members making up assemblies 120 and 122 are shown in FIG. 2). Additionally, each rack 120, 122 may be adapted for movement between an extended loading position (not shown) in which the rack 120, 122 is substantially positioned outside the wash chamber 106, and a retracted position (shown in FIGS. 1 and 2) in which the rack 120, 122 is located inside the wash chamber 106. This may be facilitated by rollers 126 and 128, for example, mounted onto racks 120 and 122, respectively.

In some embodiments, a basket 170 is removably mounted to lower rack assembly 122. In additional or alternative exemplary embodiments, the basket 170 can be selectively or removably attached to other portions of dishwashing appliance 100 (e.g., upper rack assembly 120 or door 108). The basket 170 defines one or more storage chambers and is generally configured to receive of silverware, flatware, utensils, and the like, that are too small to be accommodated by the upper and lower rack assemblies 120, 122. The basket 170 may be constructed of any suitable material (e.g., metal or polymer) and define a plurality of fluid slots 178 for permitting wash fluid therethrough.

The dishwashing appliance 100 includes one or more spray assemblies housed within the wash chamber 106. For instance, the dishwashing appliance 100 may include a lower spray-arm assembly 130 that is rotatably mounted within a lower region 132 of the wash chamber 106 directly above the bottom wall 162 of the tub 104 so as to rotate in relatively close proximity to the rack assembly 122. As shown in FIG. 2, a mid-level spray-arm assembly 136 may be located in an upper region of the wash chamber 106, such as by being located in close proximity to the upper rack 120. Moreover, an upper spray assembly 138 may be located above the upper rack 120.

As is generally understood, the lower and mid-level spray-arm assemblies 130, 136 and the upper spray assembly 138 may generally form part of a fluid circulation assembly 140 for circulating fluid (e.g., water and dishwasher fluid) within the tub 104. As shown in FIG. 2, the fluid circulation assembly 140 may also include a pump 142 located in a machinery compartment 144 located below the bottom wall 162 of the tub 104. One or all of the spray assemblies 130, 136, 138 may be in fluid communication with the pump 142 (e.g., to receive a pressurized wash fluid therefrom). Additionally, each spray-arm assembly 130, 136 may include an arrangement of discharge ports or orifices for directing washing liquid onto dishes or other articles located in rack assemblies 120 and 122, which may provide a rotational force by virtue of wash fluid flowing through the discharge ports. The resultant rotation of the lower spray-arm assembly 130 provides coverage of dishes and other dishwasher contents with a spray (e.g., a spray of wash fluid).

It should be appreciated that, although the dishwashing appliance 100 will generally be described herein as including three spray assemblies 130, 136, 138, the dishwashing appliance may, in alternative embodiments, include any other number of spray assemblies, including two spray assemblies, four spray assemblies or five or more spray assemblies. For instance, in addition to the lower and mid-level spray-arm assemblies 130, 136 and the upper spray assembly 138 (or as an alternative thereto), the dishwashing appliance 100 may include one or more other spray assemblies or wash zones for distributing fluid within the wash chamber 106.

The dishwashing appliance 100 may be further equipped with a controller 146 configured to regulate operation of the dishwasher 100. The controller 146 may generally include one or more memory devices and one or more microprocessors, such as one or more general or special purpose microprocessors operable to execute programming instructions or micro-control code associated with a cleaning cycle. The memory may represent random access memory such as DRAM, or read only memory such as ROM or FLASH. In some embodiments, the processor executes programming instructions stored in memory. The memory may be a separate component from the processor or may be included onboard within the processor.

The controller 146 may be positioned in a variety of locations throughout dishwashing appliance 100. In the illustrated embodiment, the controller 146 is located within a control panel area 148 of the door 108, as shown in FIG. 1. In such an embodiment, input/output ("I/O") signals may be routed between the control system and various operational components of dishwashing appliance 100 along wiring harnesses that may be routed through the bottom 110 of the door 108. Typically, the controller 146 includes a user interface panel/controls 150 through which a user may select various operational features and modes and monitor progress of the dishwasher 100. In one embodiment, the user interface 150 may represent a general purpose I/O ("GPIO") device or functional block. Additionally, the user interface 150 may include input components, such as one or more of a variety of electrical, mechanical or electro-mechanical input devices including rotary dials, push buttons, and touch pads. The user interface 150 may also include a display component, such as a digital or analog display device designed to provide operational feedback to a user. The user interface 150 may be in communication with the controller 146 via one or more signal lines or shared communication busses.

Additionally, as shown in FIG. 2, a portion of the bottom wall 162 of the tub 104 may be configured as a tub sump portion 152 that is configured to accommodate one or more components of the fluid recirculation assembly 140 (e.g., a filter assembly (not shown) or other components). It should be appreciated that, in several embodiments, the bottom wall 162 of the tub 104 may be formed as a single, unitary component such that the tub sump portion 152 as well as the surrounding portions of the bottom wall 162 are formed integrally with one another. Alternatively, the tub sump portion 152 may be configured as a separate component configured to be attached to the remaining portion(s) of the bottom wall 162.

Moreover, as shown in FIG. 2, the fluid recirculation assembly 140 may also include a diverter assembly 184 in fluid communication with the pump 142 for diverting fluid between one or more of the spray-arm assemblies 130, 136, 138. For example, the diverter assembly 184 may, in several embodiments, include an inlet 192 coupled to the pump 142 (e.g., via pump conduit 180 shown in FIG. 2) for directing fluid into the diverter assembly 184 and first and second outlets 186, 188 for directing the fluid received from the pump 142 to the lower spray-arm assembly 130 or the mid-level and upper spray-arm assemblies 136, 138, respectively. In some such embodiments, the first outlet 186 may be configured to be directly coupled to the lower spray-arm assembly 130 and the second outlet 188 may be coupled to a suitable fluid conduit 182 of the fluid recirculation assembly 140 for directing fluid to the mid-level and upper spray-arm assemblies 136, 138. Optionally, a third outlet 190 may direct the fluid received from the pump 142 to a variable jet assembly 196. Additionally, the diverter assembly 184 may also include a diverting valve 194 to selectively divert the flow of fluid through the assembly 184 to the first outlet 186, the second outlet 188, or the third outlet 190.

It should be appreciated that the present subject matter is not limited to any particular style, model, or configuration of dishwashing appliance. The exemplary embodiments depicted in FIGS. 1 and 2 are simply provided for illustrative purposes only. For example, different locations may be provided for the user interface 150, different configurations may be provided for the racks 120, 122, and other differences may be applied as well.

Referring now to FIGS. 3 through 6, several views of a removable rack accessory 300 for a dishwasher appliance (e.g., dishwasher appliance 100) are provided. With specific reference to FIGS. 3 through 6, rack accessory 300 may define a vertical direction V, a lateral direction L, and a transverse direction T. The defined directions with reference to FIGS. 3 through 6 may or may not coincide with the defined directions with reference to FIGS. 1 and 2. For instance, rack accessory 300 may be rotatable with respect to rack assembly 120. The directions may coincide when rack assembly 3 is moved to a downward use position (e.g., FIG. 6) to accept articles thereon. Accordingly, hereinafter, the defined directions relating to FIGS. 3 through 6 refer to rack accessory 300 unrelated to dishwasher appliance 100 shown in FIGS. 1 and 2, except as otherwise indicated.

Removable rack accessory 300 may include a body 302. For instance, body 302 may define a thickness 303 along the vertical direction V. According to at least one embodiment, the thickness 303 is between about 0.25 inches and about 0.5 inches. Body 302 may further define a length along the transverse direction T and a width along the lateral direction L. According to some embodiments, the length of body 302 may be between about 3 inches and about 5 inches, and the width of body 302 may be between about 7 inches and about 10 inches. However, it should be understood that dimensions of body 302 may vary according to specific embodiments, and the disclosure is not limited to the examples given herein, except as otherwise indicated.

Body 302 may have a lattice-type structure. For instance, body 302 may include a plurality of struts 304. According to at least some embodiments, struts 304 extends along the lateral direction L. The plurality of struts 304 may be predominantly parallel to each other. In some alternate embodiments, however, each of the plurality of struts 304 extend at angles (e.g., greater than 0) with respect to each other. For instance, a first strut 304 may extend at an angle between the lateral direction L and the transverse direction T, while a second strut 304 extends at a different angle between the lateral direction and the transverse direction T. Accordingly, a distance between adjacent struts 304 along the transverse direction T may vary along the lateral direction L (e.g., forming a trapezoidal gap therebetween).

Body 302 may further include a peripheral frame 306. In detail, peripheral frame 306 may define a periphery or outer horizontal surface of body 302. Peripheral frame 306 may include a first lateral side 308, a second lateral side 310, a first transverse side 312, and a second transverse side 314. According to some embodiments, struts 304 extend between first lateral side 308 and second lateral side 310. Additionally or alternatively, struts 304 may be predominantly parallel with first transverse side 312 and second transverse side 314. Accordingly, peripheral frame 306 and the plurality of struts 304 may collectively define a plurality of apertures 316.

Figure 3:
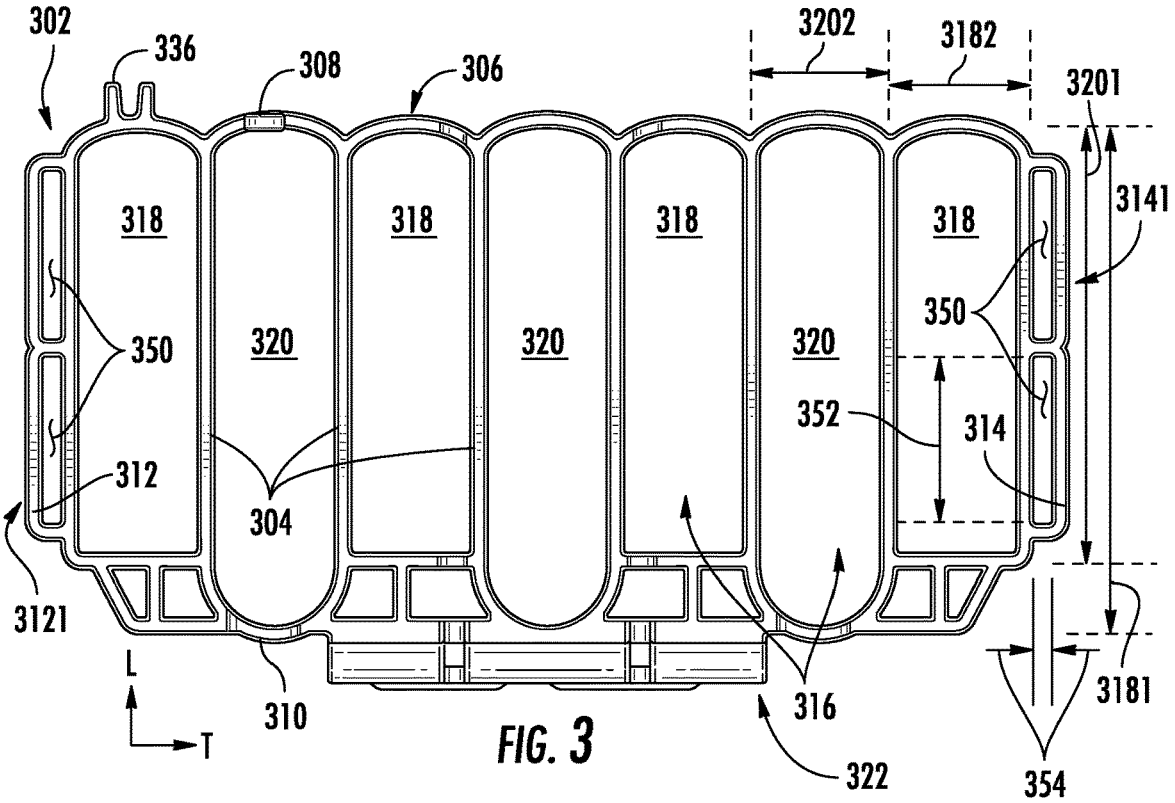
FIG. 3 provides a top view of an exemplary rack accessory according to embodiments of the present disclosure.
Figure 4:
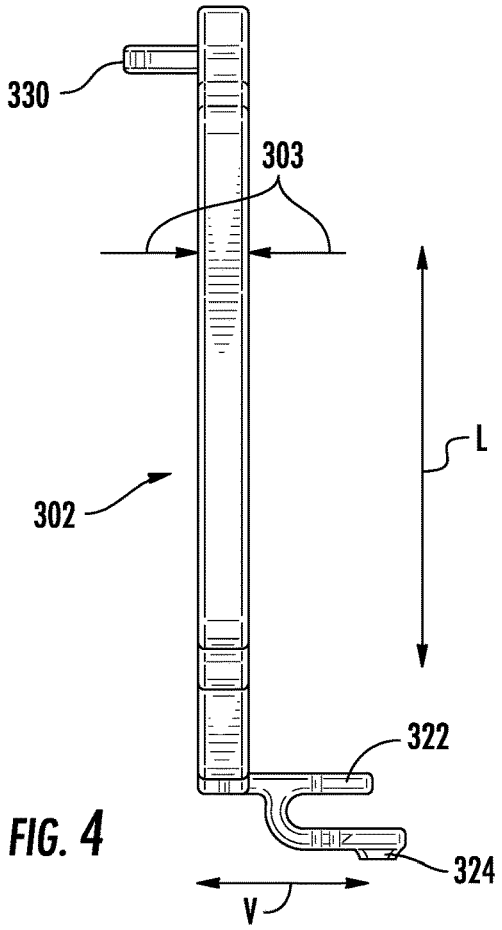
FIG. 4 provides a side view of the exemplary rack accessory of FIG. 3.

In detail, the plurality of apertures 316 may be formed through body 302 along the vertical direction V. The plurality of apertures 316 may be arranged (e.g., spaced apart) along the transverse direction T. For instance, a discrete aperture 316 may be disposed or positioned between transversely adjacent struts 304. A number or amount of apertures 316 may vary according to specific embodiments. For at least one example, seven apertures 316 are formed (e.g., as shown in FIG. 3). However, it should be understood that the disclosure is not limited to the examples given herein, and that any suitable number of apertures 316 may be formed.

The plurality of apertures 316 may include a first set of apertures 318 and a second set of apertures 320 of discrete or different sizes. In detail, the first set of apertures 318 may be interposed with the second set of apertures 320. For instance, along the transverse direction T, one aperture of the first set of apertures 318 may be formed between, e.g., first transverse side 312 and a first strut 304. One aperture of the second set of apertures 320 may thus be formed adjacent to the one of the first set of apertures 318. In detail, the one aperture of the second set of apertures 320 may be formed between the first strut 304 and a second strut 304. Accordingly, along the transverse direction T, the first set of apertures 318 and the second set of apertures 320 may be alternately formed. It should be noted that the arrangement of the first and second sets of apertures 318 and 320 is not limited to the examples given herein. For instance, the second set of apertures 320 may be positioned at a first transverse end of body 302 while the first set of apertures 318 are provided at a second transverse end of body 302. Thus, any suitable arrangement or combination of apertures 316 may be provided.

Each aperture 316 of the first set of apertures 318 may define a first length 3181 and a first width 3182. In detail, first length 3181 may be defined along the lateral direction L (e.g., between first lateral side 308 and second lateral side 310 of peripheral frame 306). Accordingly, first width 3182 may be defined along the transverse direction T (e.g., perpendicular to first length 3181). A ratio between first length 3181 and first width 3182 may be between about 3 to 1 and about 5 to 1. For instance, first length 3181 may be between about 3 and about 5 times greater than first width 3182.

Each aperture 316 of the second set of apertures 320 may define a second length 3201 and a second width 3202. In detail, second length 3201 may be defined along the lateral direction L (e.g., between first lateral side 308 and second lateral side 310 of peripheral frame 306). Accordingly, second width 3202 may be defined along the transverse direction T (e.g., perpendicular to second length 3201). A ratio between second length 3201 and second width 3202 may be between about 4 to 1 and about 6 to 1. For instance, second length 3201 may be between about 4 and about 6 times greater than second width 3202.

As described above, the first set of apertures 318 and the second set of apertures 320 may be alternately arranged along body 302. First width 3182 may be approximately equal to second width 3202. In alternate embodiments, first width 3182 is greater than second width 3202. In still alternate embodiments, first width 3182 is less than second width 3202. Further, as described above, each of first width 3182 and second width 3202 may vary along the lateral direction L. Thus, the plurality of apertures 316 may be formed as alternating trapezoids. Advantageously, a variety of different sizes of items may be accepted within each of the first set of apertures 318 and the second set of apertures 320.

First lateral side 308 may be formed with a plurality of curvatures. In detail, with reference to FIG. 3, first lateral side 308 may be convex outward (e.g., away from apertures 316) along the lateral direction L between adjacent struts 304. Accordingly, first lateral side 308 may form a series of ridges that provide selective elongation to each of the plurality of apertures 316. Similarly, second lateral side 310 may vary at each aperture of the plurality of apertures 316. For instance, second lateral side 310 may be straight at each of the first set of apertures 318. Additionally or alternatively, second lateral side 310 may be curved at each of the second set of apertures 320. In detail, second lateral side 310 may be convex outward (e.g., away from apertures 316) along the lateral direction L.

Rack accessory 300 may include a mounting portion 322. In detail, mounting portion 322 may extend or protrude from body 302 (e.g., from second lateral side 310 of peripheral frame 306). Mounting portion 322 may extend along the vertical direction V. According to at least some embodiments, mounting portion 322 extends downward along the vertical direction V (e.g., with reference to an installed position of rack accessory 300 within dishwasher appliance 100). Mounting portion 322 may include at least one slide tab 324. The at least one slide tab 324 may extend along the transverse direction T (e.g., toward second transverse side 314). Slide tab 324 may at least partially form a groove 326 (described below) for attaching rack accessory 300 to rack assembly 120. For instance, slide tab 324 may be spaced apart from mounting portion 322 along each of the transverse direction T and the vertical direction V. According to one embodiment, two slide tabs 324 are provided.

Figure 5:
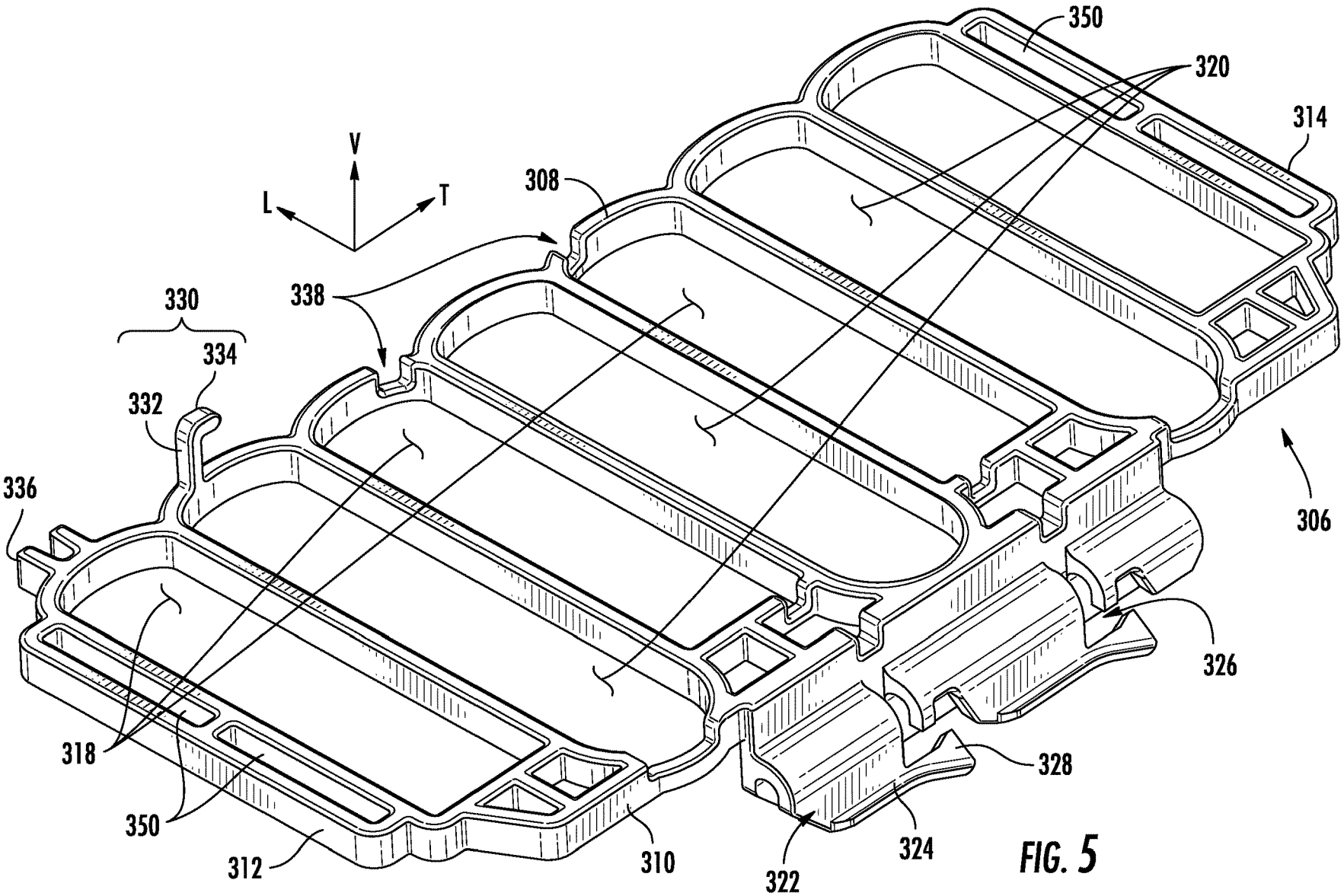
FIG. 5 provides a perspective view of the exemplary rack accessory of FIG. 3.

Mounting portion 322 may define a plurality of grooves 326 therein. With reference to FIG. 5, a single groove 326 will be described in relation to a single slide tab 324. It should be understood that this description will apply to each additional slide tab 324 or groove 326 provided. Groove 326 may be formed between slide tab 324 and mounting portion 322. For instance, groove 326 may extend from a vertically distal point of mounting portion 322 first along the vertical direction V, subsequently along the transverse direction T, and finally along the lateral direction L. Thus, a serpentine path may be formed by groove 326. Accordingly, groove 326 may form an opening along the vertical direction V and lateral direction L. Groove 326 may thus freely allow rack accessory 300 to attach to rack assembly 120 and rotate while attached to the rack (e.g., in a rotatable fashion). Additionally or alternatively, slide tab 324 may include a protrusion 328 extending along the vertical direction V (e.g., toward mounting portion 322). Protrusion 328 may partially form groove 326 (e.g., the vertical and transverse portions thereof).

In detail, rack accessory 300 may be selectively attached to a rack (e.g., rack assembly 120) within dishwasher appliance 100. Rack assembly 120 may include one or more tines therein, subsequently forming a lattice structure of the rack. Moreover, groove 326 may be defined as a complementary negative of at least one tine of the rack. In turn, groove 326 may be maneuvered into place such that a tine is accepted within groove 326. A user may subsequently feed rack accessory 300 along the tine, following groove 326. In at least one example, the user may first slide mounting portion 322 downward (e.g., along the vertical direction V) into or onto a tine, and then slide mounting portion toward a front (or rear) of the rack (e.g., along the transverse direction T) such that the tine is positioned past protrusion 328 of slide tab 324. Rack accessory 300 may then be rotatable about one or more tines within the one or more grooves 326 (e.g., along the vertical direction V). Advantageously, when not in use, rack accessory 300 may be rotated so as to be parallel with a side wall of rack assembly 120.

Body 302 may further define a plurality of grooves 338 formed therein along the vertical direction V. In detail, first lateral side 308 and second lateral side 310 may each have one or more grooves 338 formed therein. A first set of grooves 338 may be formed colinear with the lateral portion of groove 326. For instance, a first groove 338 in first lateral side 308 and a second groove 228 in second lateral side 310 may be in line with groove 326 along the lateral direction L. Similar to groove 326, grooves 338 may be defined as a complementary negatives of at least one tine. Accordingly, when rack accessory 300 is rotated to a stored position, one or more tines of rack assembly 120 may be accepted within the plurality of grooves 338.

Rack accessory 300 may include a snap hook 330. Snap hook 330 may protrude from body 302 along the vertical direction V. In detail, snap hook 330 may protrude upward along the vertical direction V (e.g., in a direction away from mounting portion 322). Snap hook 330 may include a hook base 332 and a hook arm 334. Hook base 332 may extend predominantly along the vertical direction V. Hook arm 334 may extend from a distal end of hook base 332 (e.g., along the transverse direction T). Accordingly, when rack accessory 300 is rotated to a stored position, snap hook 330 may latch onto a tine of rack assembly 120. In detail, hook arm 334 may snap over the tine to restrict a movement (e.g., along the lateral direction L) of rack accessory 300. Advantageously, when not in use, rack accessory 300 may not take up storage space within rack assembly 120 so as to allow for placement of other washing items.

Rack accessory 300 may include a locator hook 336. Locator hook 336 may protrude from body 302 along the lateral direction L away from the plurality of apertures 316. For instance, locator hook 336 may protrude from first lateral side 308 of peripheral frame 306. In detail, locator hook 336 may be generally U-shaped, having an opening facing generally along the lateral direction L. Additionally or alternatively, locator hook 336 may be open along the vertical direction V. Accordingly, locator hook 336 may include two protrusions spaced apart along the transverse direction T. According to at least some embodiments, locator hook 336 is spaced apart from snap hook 330 (e.g., along the transverse direction T). In detail, locator hook 336 and snap hook 330 may be spaced according to a spacing distance of tines of rack assembly 120. Accordingly, each of snap hook 330 and locator hook 336 may interact with or engage a different tine.

Figure 6:
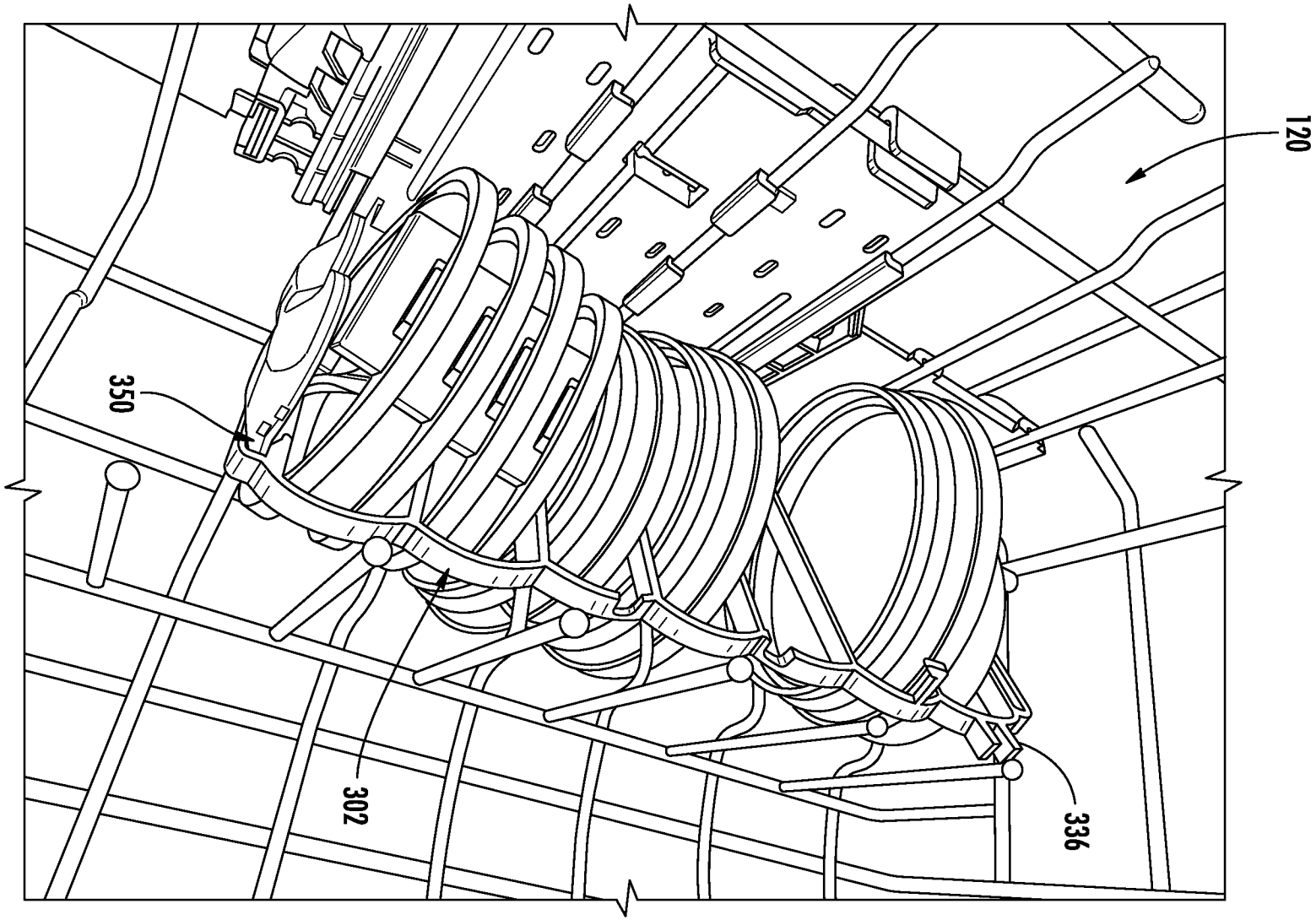
FIG. 6 provides a perspective view of the exemplary rack accessory of FIG. 3 with washing items accommodated therein.

Locator hook 336 may accept a tine therein, e.g., when rack accessory 300 is in a usable position. For instance, when rack accessory 300 is rotated from the stored position to the usable position, locator hook 336 selectively hooks onto the tine of the rack assembly 120. As shown in FIGS. 5 and 6, locator hook 336 is able to restrict a motion of rack accessory 300 along the transverse direction T (e.g., while in the usable position). Advantageously, washing items provided within, for example, the plurality of apertures 316 may be kept in place during a washing cycle.

Rack accessory 300 may include a side slot 350. Side slot 350 may be provided adjacent to the plurality of apertures 316 (e.g., along the transverse direction T). Side slot 350 may extend fully through body 302 such that side slot 350 is open at both vertical ends to permit water to flow through side slot 350. For instance, side slot 350 may be positioned on an outside edge of first transverse side 312 (i.e., a first transverse edge 3121) of peripheral frame 306. Thus, first transverse side 312 may be positioned between side slot 350 and a first aperture of the first set of apertures 318. According to at least some embodiments, a plurality of side slots 350 is provided along first transverse side 312. Additionally or alternatively, a plurality of side slots 350 may be provided along an outside edge of second transverse side 314 (e.g., adjacent the plurality of apertures 316). Accordingly, a first side slot 350 may be provided along first transverse side 312 and a second side slot 350 may be provided along second transverse side 314 (i.e., a second transverse edge 3141). The first and second side slots 350 may thus be spaced apart along the transverse direction T. It should be understood that a number of side slots 350 provided may vary according to specific embodiments, and the disclosure is not limited to the examples given herein.

Side slot 350 may define a slot length 352 and a slot width 354. Slot length 352 may be defined along the lateral direction L. Slot width 354 may be defined along the transverse direction T (e.g., perpendicular to slot length 352). Side slot 350 may be elongated along the lateral direction L, such that slot length 352 is greater than slot width 354. In at least one example, slot length 352 is between about 7 to about 10 times greater than slot width 354. Advantageously, thin elongated washing items may be accepted within side slot 350. Additionally or alternatively, slot length 352 may be shorter than first length 3181 and second length 3201. Slot width 354 may be shorter than first width 3182 and second width 3202. Thus, an overall aperture area of side slot 350 may be smaller than an overall aperture area of each of the plurality of apertures 316.

According to embodiments described herein, a removable rack accessory for a dishwashing appliance is provided. The removable rack accessory may be a lattice-type structure including a plurality of struts defining a plurality of elongated apertures or slots. For one example, lids for certain travel cups or mugs may be accepted within each of the elongated apertures. Moreover, removable features of lids may also be secured within the rack accessory to be washed. The rack accessory may include a mounting portion allowing the rack accessory to be selectively mounted to a wash rack. The mounting portion may allow the rack accessory to rotate with respect to the tines, for example, between a usable position and a stored position. The rack accessory may include a snap hook. The snap hook may selectively latch the rack accessory to an upright tine when in the stored position. The rack accessory may include a locator hook. The locator hook may prevent a transverse motion of the rack accessory during a washing cycle. One or more side slots may be formed on the rack accessory adjacent to the plurality of elongated apertures.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A removable rack accessory for a dishwashing appliance, the removable rack accessory defining a vertical direction, a lateral direction, and a transverse direction, the removable rack accessory comprising:

a body comprising a plurality of struts extending along the lateral direction, the plurality of struts collectively defining a plurality of apertures for receiving one or more tumbler lids therein;

a mounting portion extending from the body along the vertical direction, the mounting portion comprising a slide tab extending along the transverse direction, wherein the mounting portion is configured to rotatably attach the body to a wash rack within the dishwashing appliance, and wherein the mounting portion defines a groove comprising a transverse portion extending along the transverse direction, a lateral portion extending along the lateral direction, and a vertical portion extending along the vertical direction;

a snap hook protruding from the body along the vertical direction for selectively latching the body to the wash rack; and a locator hook protruding from the body along the lateral direction away from the plurality of apertures.

2. The removable rack accessory of claim 1, wherein the plurality of apertures comprises:

a first set of apertures, each of the first set of apertures defining a first length and a first width, wherein a ratio of the first length to the first width is between 3 to 1 and 5 to 1; and a second set of apertures, each of the second set of apertures defining a second length and a second width, wherein a ratio of the second length to the second width is between 4 to 1 and 6 to 1.

3. The removable rack accessory of claim 2, wherein the first and second widths are defined along the transverse direction, the first width being equal to the second width.

4. The removable rack accessory of claim 2, wherein the first and second lengths are defined along the lateral direction, the second length being greater than the first length.

5. The removable rack accessory of claim 2, further comprising:

at least one side slot provided adjacent to the plurality of apertures, the side slot defining a slot width and a slot length.

6. The removable rack accessory of claim 5, wherein the slot length is shorter than the first length and the second length, and wherein the slot width is shorter than the first width and the second width.

7. The removable rack accessory of claim 5, wherein the at least one side slot comprises:

a first side slot extending from a first transverse edge of the body; and a second side slot extending from a second transverse edge of the body, the second transverse edge being spaced apart from the first transverse edge along the transverse direction.

8. The removable rack accessory of claim 1, wherein the mounting portion extends downward along the vertical direction from a lateral edge of the body, and wherein the snap hook extends upward along the vertical direction away from the mounting portion.

9. The removable rack accessory of claim 1, wherein a thickness of the body along the vertical direction is between 0.25 inches and 0.50 inches.

10. A dishwashing appliance; comprising:

a tub defining a wash chamber;

a rack assembly slidably disposed within the wash chamber; and a removable rack accessory rotatably attached to the rack assembly, the removable rack accessory defining a vertical direction, a lateral direction, and a transverse direction, wherein the removable rack accessory comprises:

a body comprising a plurality of struts extending along the lateral direction, the plurality of struts collectively defining a plurality of apertures for receiving one or more tumbler lids therein;

a mounting portion extending from the body along the vertical direction, the mounting portion comprising a slide tab extending along the transverse direction, wherein the mounting portion is configured to rotatably attach the body to a wash rack within the dishwashing appliance, and wherein the mounting portion defines a groove comprising a transverse portion extending along the transverse direction, a lateral portion extending along the lateral direction, and a vertical portion extending along the vertical direction;

a snap hook protruding from the body along the vertical direction for selectively latching the body to the wash rack; and a locator hook protruding from the body along the lateral direction away from the plurality of apertures.

11. The dishwashing appliance of claim 10, wherein the plurality of apertures comprises:

a first set of apertures, each of the first set of apertures defining a first length and a first width, wherein a ratio of the first length to the first width is between 4 to 1 and 6 to 1; and a second set of apertures, each of the second set of apertures defining a second length and a second width, wherein a ratio of the second length to the second width is between 3 to 1 and 5 to 1.

12. The dishwashing appliance of claim 11, wherein the first and second widths are defined along the transverse direction, the first width being equal to the second width.

13. The dishwashing appliance of claim 11, wherein the first and second lengths are defined along the lateral direction, the second length being greater than the first length.

14. The dishwashing appliance of claim 11, wherein the removable rack accessory further comprises:

at least one side slot provided adjacent to the plurality of apertures, the side slot defining a slot width and a slot length.

15. The dishwashing appliance of claim 14, wherein the slot length is shorter than the first length and the second length, and wherein the slot width is shorter than the first width and the second width.

16. The dishwashing appliance of claim 14, wherein the at least one side slot comprises:

a first side slot extending from a first transverse edge of the body; and a second side slot extending from a second transverse edge of the body, the second transverse edge being spaced apart from the first transverse edge along the transverse direction.

17. The dishwashing appliance of claim 10, wherein the mounting portion extends upward/downward along the vertical direction from a lateral edge of the body, and wherein the snap hook extends downward/upward along the vertical direction away from the mounting portion.

18. The dishwashing appliance of claim 10, wherein a thickness of the body along the vertical direction is between 0.25 inches and 0.50 inches.

* * * * *